US006126476A

United States Patent [19]

Viklund et al.

[11] Patent Number: 6,126,476

[45] **Date of Patent: *Oct. 3, 2000**

[54] ENHANCED PERFORMANCE CONNECTOR

[75] Inventors: Mark Viklund, New Milford; Olindo Savi, Berlin; Joshua Adams, Manchester, all of Conn.

[73] Assignee: The Siemon Company, Watertown, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/046,396

[22] Filed: Mar. 23, 1998

[51] Int. Cl.[7] ..... H01R 4/24

[52] U.S. Cl. ..... 439/404

[58] Field of Search ..... 439/676, 404, 439/488, 395

[56] References Cited

U.S. PATENT DOCUMENTS

| | | | |
|---|---|---|---|
| 4,262,985 | 4/1981 | Muehlhausen | 439/404 |
| 4,533,196 | 8/1985 | Forberg | 439/404 |
| 5,160,273 | 11/1992 | Carney | 439/108 |
| 5,194,014 | 3/1993 | McClune et al. | 439/404 |
| 5,324,211 | 6/1994 | Siemon et al. | 439/404 |
| 5,328,380 | 7/1994 | Carney | 439/608 |
| 5,399,107 | 3/1995 | Gentry et al. | 439/676 |
| 5,494,461 | 2/1996 | Bippus et al. | 439/709 |
| 5,591,045 | 1/1997 | Pepe et al. | 439/404 |
| 5,628,647 | 5/1997 | Rohrbugh et al. | 439/404 |
| 5,639,266 | 6/1997 | Patel | 439/676 |
| 5,645,445 | 7/1997 | Siemon et al. | 439/395 |
| 5,772,472 | 6/1998 | Beutler et al. | 439/608 |
| 5,975,919 | 11/1999 | Arnett et al. | 439/676 |

OTHER PUBLICATIONS

Lucent Technologies, Certified Systimax® SCS Component, Jan. 14, 1998, sketch of contacts.

ICC Patch Cord Solutions, sketch of contacts.

AMP, 110ConnectXC Patch Plugs, Sep. 1996; sketch of contacts.

Panduit™, Pan–Punch™ 110 Punchdown System, date unknown; sketch of contacts.

Sentinel Connector Systems Inc., Aug. 9,1997.

Hubbel Premise Wiring, Inc., Snap On Modular Plugs, Full Line Catalog 2100, date unknown.

Stewart, Category 5 Plugs, date unknown.

AMP, Modular Plugs, Sep., 1996.

Nevada Western O.M.N.I., Connectors, Couplers and Adapters, Information Outlets 1995.

700A8 Modular Wire Plugs, Issue 5, Apr., 1996.

AMP, 110Connect XC Cross Connect System, date unknown.

UTP Patching, KATT Premises Distribution System (PDS), date unknown.

AMP, High Performance Modular Jacks, date unknown.

Category 5 Horizontal & Vertical Jacks, 1995.

*Primary Examiner*—Paula Bradley
*Assistant Examiner*—Briggitte R. Hammond
*Attorney, Agent, or Firm*—Cantor Colburn LLP

[57] ABSTRACT

A connector including a plug, and outlet and a connecting block each of which provides enhanced performance by reducing crosstalk. The plug includes contacts having a reduced amount of adjacent area between neighboring contacts and a load bar that staggers the wires to be terminated to the contacts. An outlet which mates with the plug includes contacts positioned in a contact carrier so that adjacent area between neighboring contacts is reduced. A connecting block includes pairs of contacts wherein the distance between contacts in a pair is smaller than the distance between sets of pairs. The connecting block also includes an improved tip that reduces untwisting of wire coupled to the connecting block.

15 Claims, 11 Drawing Sheets

ENHANCED PERFORMANCE CONNECTOR

FIELD OF THE INVENTION

The invention relates generally to an enhanced performance connector and in particular, to a connector including a plug, outlet and connecting block each of which is designed for enhanced performance.

BACKGROUND OF THE INVENTION

Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 MHZ. New standards are being developed continuously and currently it is expected that future standards will require transmission requirements of at least 600 MHZ.

The above referenced transmission requirements also specify limits on near-end crosstalk (NEXT). Often, telecommunications connectors are organized in sets of pairs, typically made up of a tip and ring connector. As telecommunications connectors are reduced in size, adjacent pairs are placed closer to each other creating crosstalk between adjacent pairs. To comply with the near-end crosstalk requirements, a variety of techniques are used in the art.

Existing telecommunications products include plugs, outlets and connecting blocks. Each of these devices can suffer from crosstalk as the rate of transmission increases. To reduce this crosstalk, modular plugs have been developed utilizing several different approaches. Prior art plugs, such as those sold by Hubbell, AT&T, and Thomas & Betts use square wire contacts to reduce contact overlap. Other prior art plugs, such as those sold by Amp and RJ Enterprises use an inline load bar. Other prior art plugs, such as those sold by Stewart and Sentinel use a loadbar with a staggered, non-coplanar scheme.

Outlets have also been designed to reduce crosstalk as the rate of transmission increases. To reduce this crosstalk modular outlets have been developed utilizing resilient conductive pins with two resilient conductive pins entering the plug mating area from the rear as opposed to the usual front. Prior art devices such as that sold by Stewart have conductive pins 3 and 6 entering the plug mating area from the rear.

Connecting blocks have also been designed to reduce crosstalk. Current 110 type connecting systems are designed to support digital data transmission as well as analog/digital voice over unshielded twisted pair (UTP) media through the use of wiring blocks, connecting blocks and patch cords or jumpers. This system facilitates moves and rearrangements of circuits connected to end-users or equipment. These 110 type blocks use punch down insulation displacement contacts (IDC) to maximize density and ease of use. A limitation of prior art devices is the difficulty encountered when lacing and punching down twisted pair wiring. The tips of the 110 type blocks between the IDC pairs are typically blunt and require untwisting of the wire prior to lacing into the block. This could lead to excessive untwist in the pair and a loss of electrical performance. To reduce this crosstalk, conventional connecting blocks have been developed utilizing conductive shields (plates) between adjacent pairs such as those disclosed in U.S. Pat. Nos. 5,160,273 and 5,328,380.

While there exist plugs, outlets and connecting blocks designed to reduce crosstalk and enhance performance, it is understood in the art that improved plugs, outlets and connecting blocks are needed to meet increasing transmission rates.

SUMMARY OF THE INVENTION

The above-discussed and other drawbacks and deficiencies of the prior art are overcome or alleviated by the enhanced performance connector of the present invention. The connector includes a plug, an outlet and a connecting block each of which provides enhanced performance by reducing crosstalk. The plug includes contacts having a reduced amount of adjacent area between contacts and a load bar that staggers the wires to be terminated to the contacts. An outlet which mates with the plug includes contacts positioned in a contact carrier so that adjacent area between contacts is reduced. A connecting block includes pairs of contacts wherein the distance between contacts in a pair is smaller than the distance between sets of pairs. The connecting block also includes an improved tip that reduces untwisting of wire coupled to the connecting block.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIG. 12 is an exploded, perspective view of the alternative outlet;

DETAILED DESCRIPTION OF THE INVENTION

Figure 1:
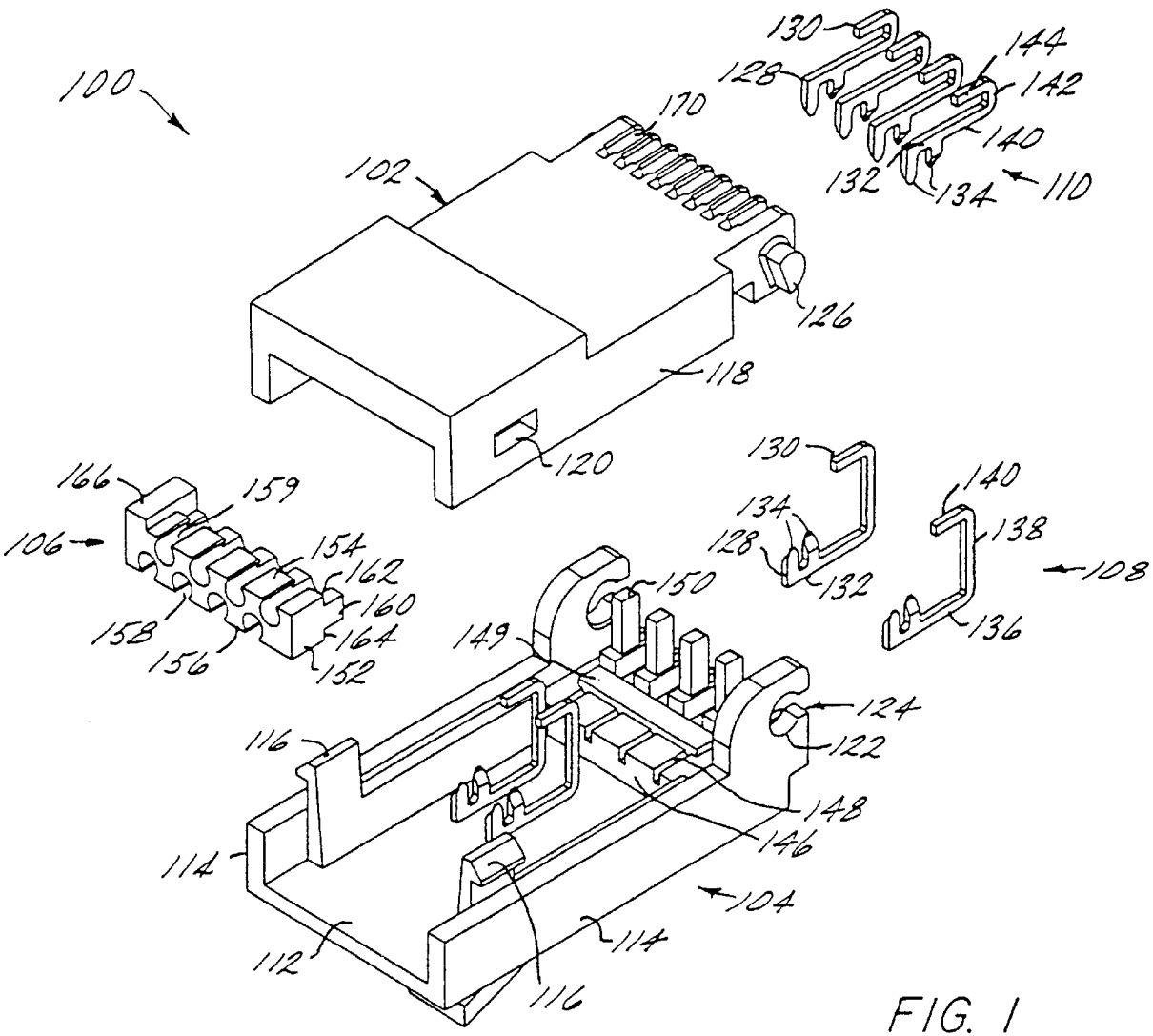
FIG. 1 is an exploded, perspective view of a plug in accordance with the present invention.

FIG. 1 is an exploded view of an enhanced performance plug, shown generally at 100, in accordance with an exemplary embodiment of the invention. The plug 100 is designed to mate with RJ-45 outlets and includes a top housing 102 that engages a bottom housing 104. Top and bottom housings are preferably made from resilient plastic but may also be shielded as is known in the art. Contacts 110 are mounted in the top housing 102 and contacts 108 are mounted in the bottom housing 104. A load bar 106 receives wires and serves to position the wires in the proper location for termination on the contacts 108 and 110.

Bottom housing 104 includes a planar base 112 and a pair of side walls 114. Extending beyond side walls 114 are two latches 116. Top housing 102 includes side walls 118 having openings 120 for receiving latches 116. Top housing 102 includes a series of spaced, isolated slots 170 that receive the distal ends 130 of contacts 108 and contacts 110. Side wall 114 also includes a circular opening 122 having a neck 124. Neck 124 has an inner dimension less than the diameter of circular opening 122. The circular opening 122 receives a hinge pin 126 formed on the top housing 102. The hinge pin 126 is a portion of a cylinder having a circular surface and a planar surface. The hinge pin 126 has a minimum width in one direction that allows the hinge pin 126 to pass through neck 124. The hinge pin 126 can only pass through neck 124 when the top housing 102 is in an open position. Upon rotation of the top housing 102 relative to the bottom housing 104, the hinge pin minimum width is no longer aligned with neck 124 and hinge pin 126 is secured in circular opening 122.

Contacts 108 and 110 each includes an insulation displacement contact (IDC) end 128 and a distal end 130. The IDC end includes a base 132 and IDC arms 134 pointing away from the base in a first direction. Referring to contact 108, extending away from IDC end 128, perpendicular to the first direction, is leg 136 which is bent approximately 90 degrees to point in the first direction to define leg 138. Leg 138 is bent approximately 90 degrees to define leg 140 which is perpendicular to the first direction.

Figure 1A:
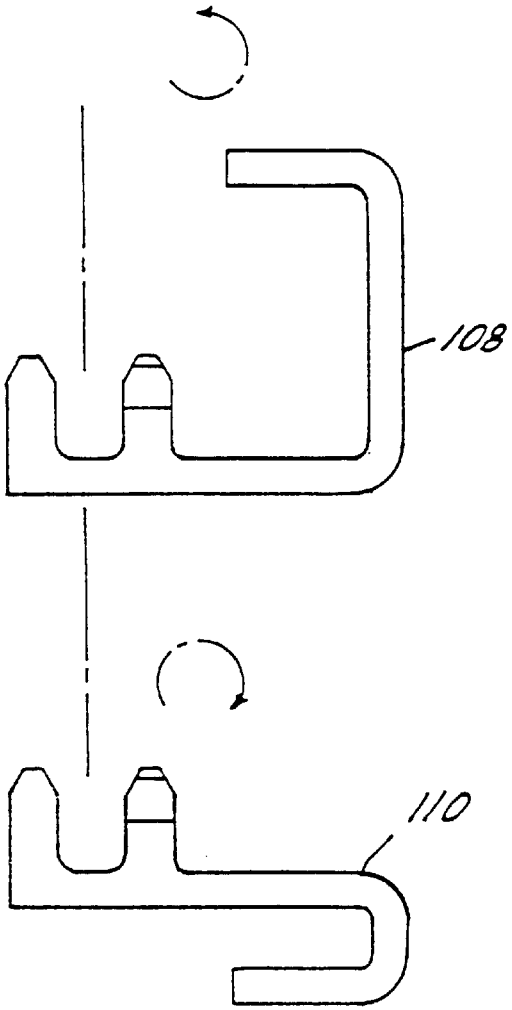
FIG. 1A is a side view of the contacts used in the plug.

Contact 110 similarly includes an IDC end 128 having IDC arms 134 extending away from a base 132 in a first direction. Leg 140 extends away from the IDC end 128 perpendicular to the first direction and is bent approximately 90 degrees to point opposite the first direction to define leg 142. Leg 142 is bent approximately 90 degrees to form leg 144 which is perpendicular to the first direction. Contact 110 differs from contact 108 in the direction of the bends with respect to the first direction. As shown in FIG. 1A, if the IDC arms 134 point in a first direction to define a reference axis, contacts 108 are bent in a counterclockwise direction and contacts 110 are bent in a clockwise direction relative to reference axis.

Bottom housing 104 includes a contact holder 146 having a plurality of channels 148 for receiving contacts 108. The contacts 108 are installed into channels 148 in a straight condition. Contacts 108 are then bent to form legs 136, 138 and 140 described above. A series of posts 150 are positioned above the channels 148 towards the exit end of each channel 148. The posts 150 help support the contacts 108 during the bending process and during the use of the plug 100. A lip 149 is provide on the top of the contact holder 146 and abuts against a bottom shoulder 164, to assist in positioning load bar 106 relative to bottom housing 104.

Load bar 106 is made from a generally rectangular block 152 having a top surface 154 and a bottom surface 156. Circular channels 159 are formed in the top surface 154 and circular channels 158 are formed in the bottom surface 156. The channels 158 in bottom surface 156 are equally spaced and offset from the channels 159, also equally spaced, in the top surface 154. The block 152 has a portion of reduced dimension (e.g. height) 160 forming a top shoulder 162 and a bottom shoulder 164 along the length of the load bar 106. Bottom shoulder 164 abuts against lip 149 to position the load bar 106 in the bottom housing 104. Side walls 114 also align the bottom channels 158 with channels 148 so that wires installed in the channels 158 are aligned with IDC ends 128 of contacts 108. Load bar 106 also includes an extension 166 that engages a recess 168 (FIG. 3) formed in the top housing 102. The plug 100 minimizes wire buckling through the use of load bar 106 which allows the wire to be terminated inside the load bar 106. Termination inside the load bar eliminates the possibility of the wires buckling, while pushing them through the load bar, and into the plug termination area.

Figure 2:
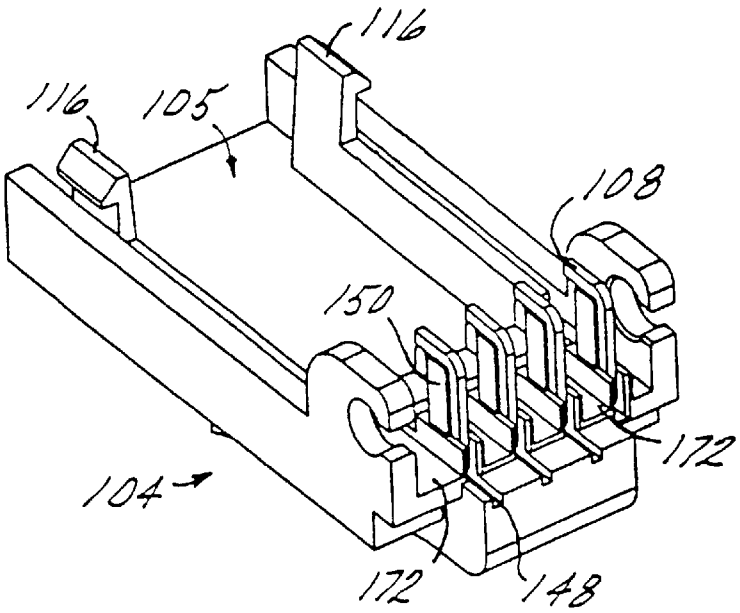
FIG. 2 is a perspective view of a bottom housing of the plug.

FIG. 2 is a perspective view of the bottom housing 104 with contacts 108 mounted therein. As shown in FIG. 2, posts 150 positioned above each channel 148 support both leg 138 and leg 140 of contacts 108. Posts 150 facilitate manufacturing by providing a surface for bending the contacts 108. Posts 150 also support the distal ends 130 of contacts 108 so that the distal ends 130 are not deflected upon mating the plug with an outlet. Recesses 172 are formed adjacent to channels 148 and provide room for the top housing 102 to rotate relative to bottom housing 104. Recesses 172 are three sided areas having a rear wall that seals the recess 172 from the interior 105 of the bottom housing 104.

Figure 3:
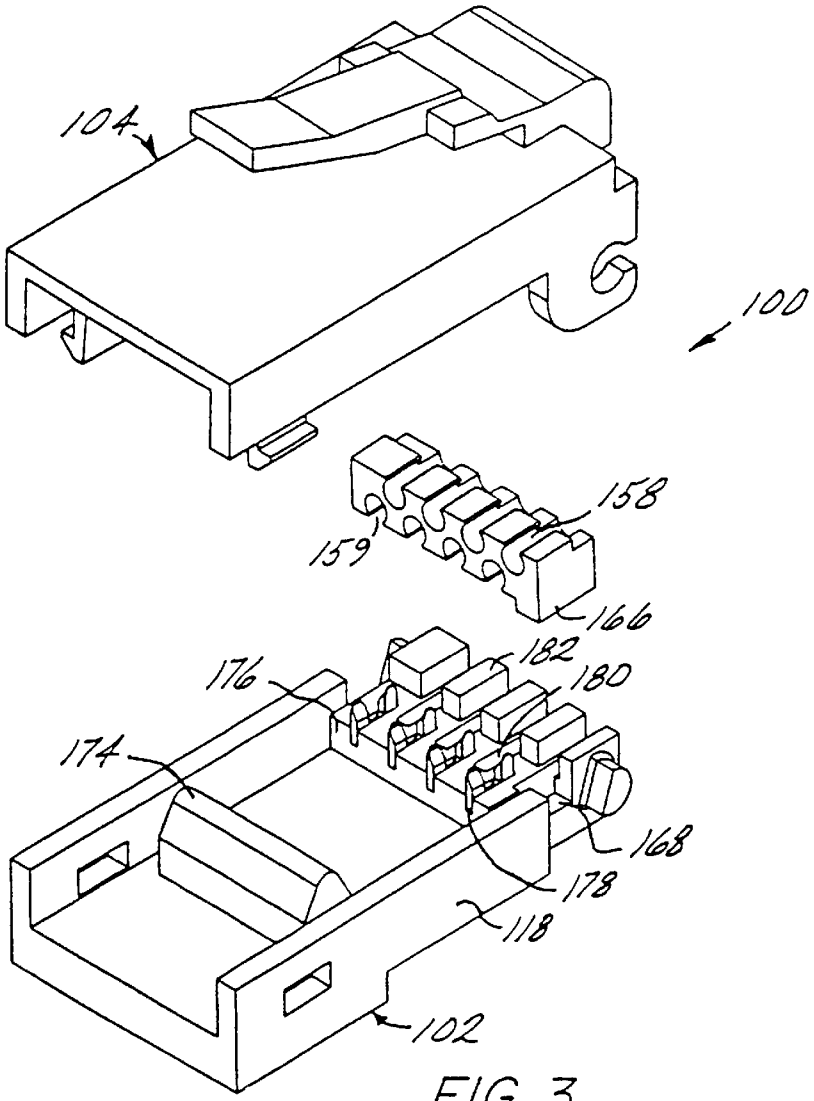
FIG. 3 is an exploded, perspective view of the plug.

FIG. 3 is an exploded perspective view of the plug 100 showing the interior of top housing 102. Top housing 102 includes a strain relief projection 174 that compresses the jacket of the incoming cable against bottom housing 104 and provides strain relief. Top housing 102 includes a contact holder 176 having a plurality of spaced channels 178 for receiving contacts 110. A plurality of openings 180 are provided on top housing 102 to allow contacts 108 to enter slots 170. A plurality of extensions 182 project away from contact holder 176 and are located to engage recesses 172 on bottom housing 104. Extensions 182 extend sufficiently into recesses 172 to prevent dust from entering the interior of plug 100 but not so deep so as to prevent rotation of top hosing 102 relative to bottom housing 104. Top housing 102 includes a recess 168 that receives extension 166 on loadbar 106. This positions loadbar 106 relative to top housing 102. Upon installation of the loadbar 106, channels 159 in loadbar 106 are aligned with channels 178 and the IDC end 128 of contacts 110.

Figure 4:
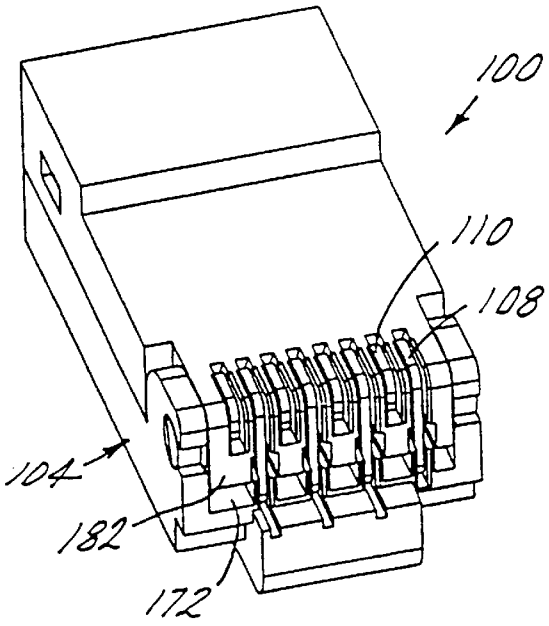
FIG. 4 is perspective view of the plug.

FIG. 4 is a perspective view of the assembled plug 100. To assemble the plug 100, wires are laced into the channels 158 and 159 and the load bar 106 is placed in either the top housing 102 or bottom housing 104. Hinge pins 126 are placed in circular openings 122 and the top housing 102 and bottom housing 104 are rotated towards one another. Channels 158 in load bar 106 are aligned with channels 148 in bottom housing 104 and channels 159 are aligned with channel 178 in top housing 102. As the top housing 102 is rotated towards the bottom housing, the IDC ends 128 of contacts 108 and 110 contact the wires in loadbar 106 piercing the insulation of each wire and establishing electrical contact between the wires and the contacts 108 and 110. Upon complete rotation, latches 116 engage openings 120 and the plug is assembled. Terminating the wires within the loadbar 106 creates a more simple final assembly because the wires do not have to be pushed through the loadbar, into the plug housing. As shown in FIG. 4, extensions 182 are positioned in recesses 172 to prevent dust and other contaminants from entering plug 100.

Contacts 108 and 110 are designed to reduce the amount of adjacent area between neighboring contacts. The distal ends of contacts 108 and 110 will be adjacent to each other in slots 170 and legs 144 and 140 will necessarily be adjacent to each other in order to mate with a standard RJ-45 outlet. The contacts 108 and 110 diverge away from each after exiting slots 170. Accordingly, there is minimal adjacent area between legs 142 and 138 and no adjacent area between legs 136 and 140. By reducing the adjacent area between neighboring contacts, crosstalk is reduced and performance is enhanced. In addition, the loadbar 106 helps improve performance. The loadbar spaces the wires in different planes (top channels 158 and bottom channels 159) which reduces the likelihood of crosstalk. In addition, the loadbar standardizes and minimizes the amount of untwist needed for each pair further reducing crosstalk. Along with reducing crosstalk, the plug of the present invention improves upon return loss and achieves better balance. This improved performance allows for data transmission at higher frequencies, with less noise from adjacent pairs.

Figure 5:
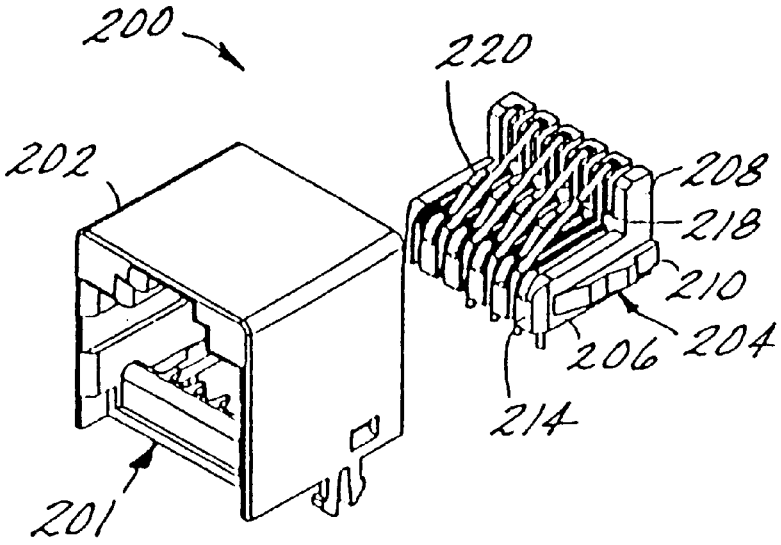
FIG. 5 is an exploded, perspective view of an outlet.
Figure 6:
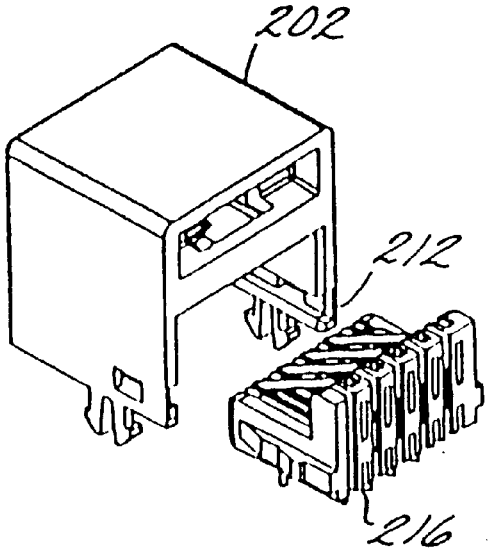
FIG. 6 is an exploded, perspective view of the outlet.

FIGS. 5 and 6 are exploded perspective views of a 90 degree version of an enhanced performance outlet shown generally at 200. The outlet 200 includes a housing 202 and a contact carrier 204 made from a resilient plastic. The outlet 200 could also be constructed as a shielded outlet as known in the art. Outlet 200 is referred to as 90 degree because opening 201 in housing 202 is in a plane perpendicular to the plane of the contact carrier 204 through which the termination ends of contacts 220 and 218 extend. The contact carrier is generally L-shaped and includes a base 206 and a rear wall 208 generally perpendicular to base 206. The contact carrier 204 has a front edge 214 disposed opposite a rear edge 216 where rear wall 208 joins base 206. Ribs 210 on the base 206 engage channels 212 formed in the side walls of the housing 202 to secure the contact carrier 204 to the housing 202. The outlet 200 includes two types of contacts 218 and 220 which have different shapes to reduce the amount of adjacent area between neighboring contacts and thus improve performance. The contacts 218 and 220 are made from gold plated or palladium nickel plated phosphor bronze wire. Contacts 218 and 220 alternate across the contact carrier 204.

Figure 7:
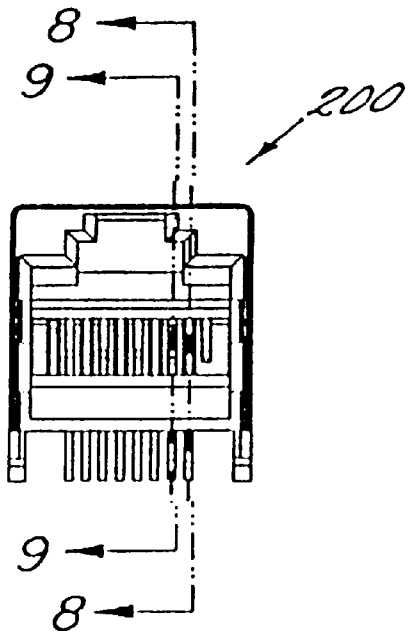
FIG. 7 is a front view of the outlet.
Figure 8:
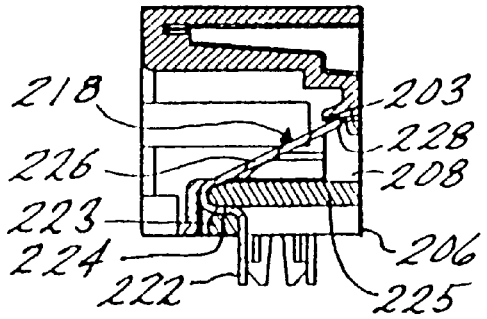
FIG. 8 is a cross-sectional view taken along line 8—8 of FIG. 7.

FIG. 7 is a front view of the outlet 200. FIG. 8 is a cross sectional view of the outlet 200 taken along line 8—8 of FIG. 7. FIG. 8 shows in detail a first contact 218. First contact 218 has a termination end 222 that engages a circuit board. From the termination end 222, contact 218 enters the bottom of contact carrier 204 and bends approximately 90 degrees to form leg 224. Contact 218 then bends more than 90 degrees but less than 180 degrees to define leg 226 that exits the contact carrier 204 proximate to front edge 214. The distal end 228 terminates within the rear wall 208 and is positioned below lip 203 formed on the inside of housing 202. The path for contact 218 is provided by a first channel formed through the contact carrier 204. The path is provided in part by a first member 223 positioned proximate to the bottom of base 206 and a second member 225 positioned proximate to the top of base 206. A gap is provided between first member 223 and second member 225 to receive leg 224.

Figure 9:
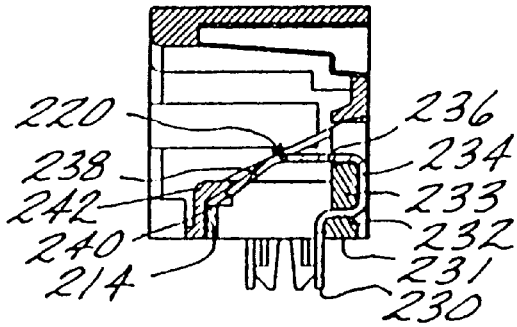
FIG. 9 is a cross-sectional view taken along line 9—9 of FIG. 7.
Figure 10:
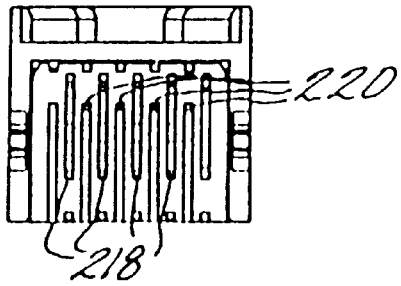
FIG. 10 is a bottom view of the outlet.

FIG. 9 is a cross-sectional view taken along line 9—9 of FIG. 7. Contact 220 alternates with contact 218 across contact carrier 204. Contact 220 has a distal end 230 extending from the bottom of contact carrier 204 for mounting in a circuit board as described below. Contact 220 is bent approximately 90 degrees to define leg 232 which is bent approximately 90 degrees to define leg 234. Leg 234 is bent approximately 90 degrees to define leg 236 which is bent less than 90 degrees to define leg 238. The distal end 240 of contact 220 is positioned under a rearwardly facing lip 242 formed on the housing 202 and positioned above the front edge 214 of contact carrier 204. As is clear from FIG. 9, contact 220 exits the contact carrier 204 at the rear wall 208 opposite front edge 214. The path for contact 220 is formed in part by third member 231 portioned proximate to the bottom of base 206 and fourth member 233 positioned at the junction between base 206 and rear wall 208. A gap is provided between third member 231 and fourth member 233 to receive leg 232. FIG. 10 is a bottom view of outlet 200. The outlet 200 also reduces crosstalk in the area where the contacts 218 and 220 mate with the circuit board by spacing the row of contacts 218 and row of contacts 220 further apart than standard modular jacks (typically 0.100 in).

The contacts 218 and 220 exiting the contact carrier from opposite ends is an important feature of the present invention. By alternating contacts 218 and 220 across the contact carrier, and having contacts 218 exit the contact carrier from one end and contacts 220 exit the contact carrier 204 from the opposite end, reduces the area where contacts 218 and 220 are adjacent. This reduction in adjacency enhances performance by reducing crosstalk, improves upon return loss and achieves better balance.

Figure 11:
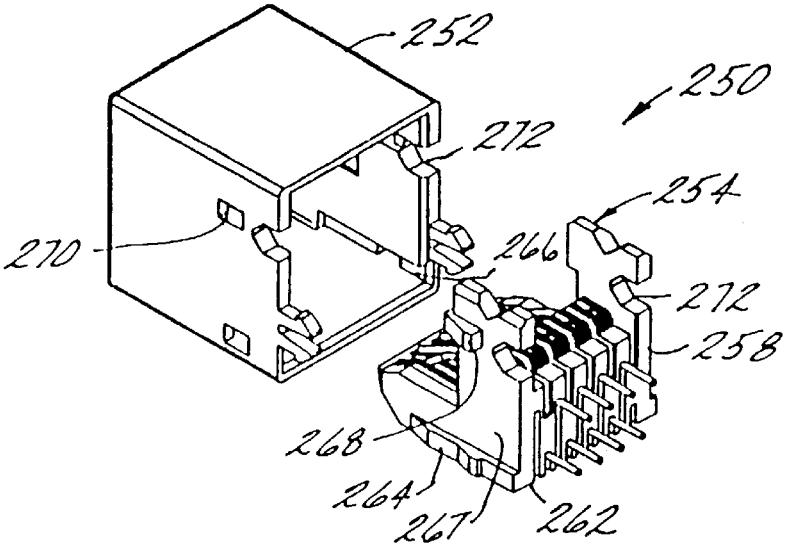
Figure 12:
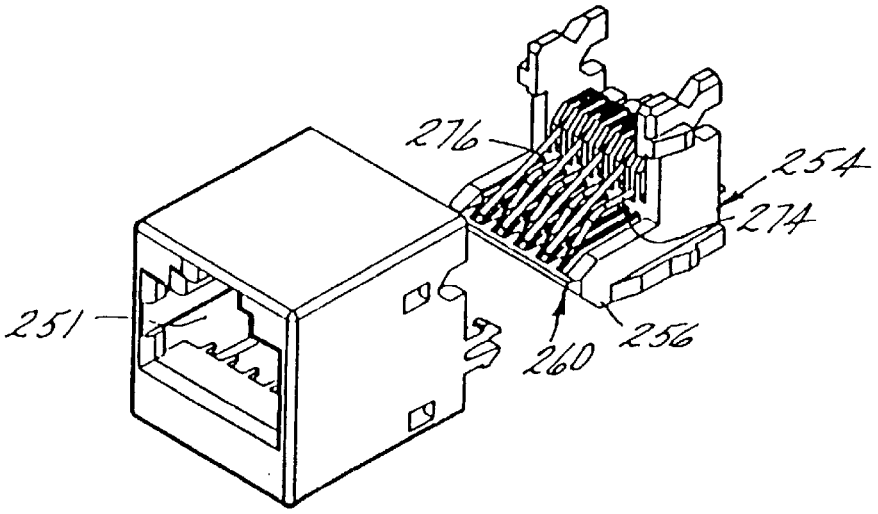
FIG. 12 is an exploded, perspective view of an alternative outlet.

FIGS. 11 and 12 are exploded perspective views of vertical version of an enhanced performance outlet shown generally at 250. The outlet 250 includes a housing 252 and a contact carrier 254 made from a resilient plastic. The outlet 250 could also be constructed as a shielded outlet as is known in the art. Outlet 250 is referred to as a vertical version because opening 251 in housing 252 is in a plane parallel to the plane of the contact carrier 254 through which the termination ends of contacts 274 and 276 extend. The contact carrier is generally L-shaped and includes a base 256 and a rear wall 258 generally perpendicular to base 256. The contact carrier 254 has a front edge 260 disposed opposite a rear edge 262 where rear wall 258 joins base 256. Ribs 264 on the base 256 engage channels 266 on the inside of housing 252 to secure the contact carrier 254 to the housing 252. A side wall 267 of contact carrier 254 includes protrusions 268 that engage openings 270 to secure the contact carrier 254 to the housing 252. Both housing 252 and rear wall 258 include recesses 272 that receive the tail of the contacts mounted in connecting block 300 described below. The outlet 250 includes two types of contacts 274 and 276 which have different shapes to reduce the amount of adjacent area between neighboring contacts and thus improve performance. The contacts 274 and 276 are made from gold plated or palladium nickel plated phosphor bronze wire. Contacts 274 and 276 alternate across the contact carrier 254.

Figure 13:
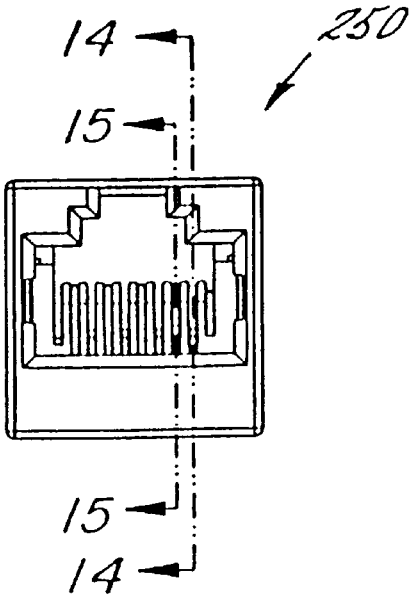
FIG. 13 is a front view of the alternative outlet.
Figure 14:
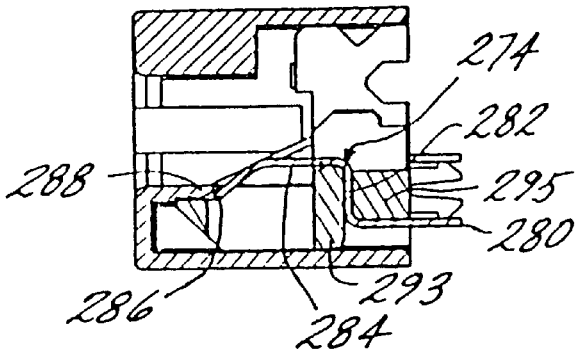
FIG. 14 is a cross-sectional view taken along line 14—14 of FIG. 13.

FIG. 13 is a front view of outlet 250. FIG. 14 is a cross sectional view of the outlet 250 taken along line 14—14 of FIG. 13. FIG. 14 shows in detail a first contact 274. First contact 274 has a termination end 280 that engages a circuit board. From the termination end 280, contact 274 enters the base 256 of contact carrier 254 and bends approximately 90 degrees to form leg 282. Contact 274 then bends approximately 90 degrees to define leg 284 that exits the rear wall 258 at a first height relative to the bottom of the base 256 and substantially perpendicular to rear wall 258. Contact 274 bends less than 90 degree and the distal end 286 terminates below rearwardly facing lip 288 formed on housing 252 and positioned above the front edge 260 of the contact carrier 254. The path for contact 274 is provided by a first channel formed through the contact carrier 254. The path is provided in part by a first member 293 and a second member 295 positioned proximate to the junction between the base 256 and the rear wall 258. A gap is provided between first member 293 and second member 295 to receive leg 282.

Figure 15:
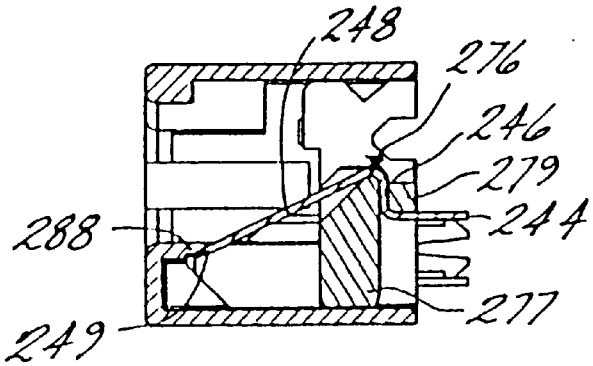
FIG. 15 is a cross-sectional view taken along line 15—15 of FIG. 13.
Figure 16:
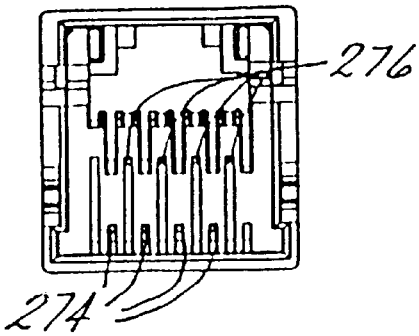
FIG. 16 is a bottom view of the alternative outlet.

FIG. 15 is a cross-sectional view taken along line 15—15 of FIG. 13. Contact 276 alternates with contact 274 across contact carrier 254. Contact 276 has a distal end 244 extending from the rear wall 258 for mounting in a circuit board as described below. Contact 276 is bent approximately 90 degrees to define leg 246 which is bent more than 90 degrees to define leg 248. Leg 248 exits the rear wall 258 at a second height relative to the bottom of the base 256 different than the exit height of first contact 274 and exits at an oblique angle relative to the rear wall 258. The distal end 249 of contact 276 is positioned under a rearwardly facing lip 288 formed on housing 252 and positioned above the front edge 260 of contact carrier 254. The path for contact 276 is formed in part by third member 277 and fourth member 279 positioned in rear wall 258. A gap is provided between third member 277 and fourth member 279 to receive leg 246. FIG. 16 is a bottom view of outlet 250. The outlet 250 also reduces crosstalk in the area where the contacts 274 and 276 mate with the circuit board by spacing the row of contacts 218 and row of contacts 220 further apart than standard modular jacks (typically 0.100 in).

The contacts 274 and 276 exiting the rear wall of the contact carrier at different heights and at different angles is an important feature of the present invention. By alternating contacts 274 and 276 across the contact carrier, and having contacts 274 and 276 exit the rear wall of the contact carrier at different heights and at different angles reduces the amount of adjacent area between neighboring contacts 274 and 276. This reduction enhances performance by reducing crosstalk, improving return loss and achieving better balance.

Figure 17:
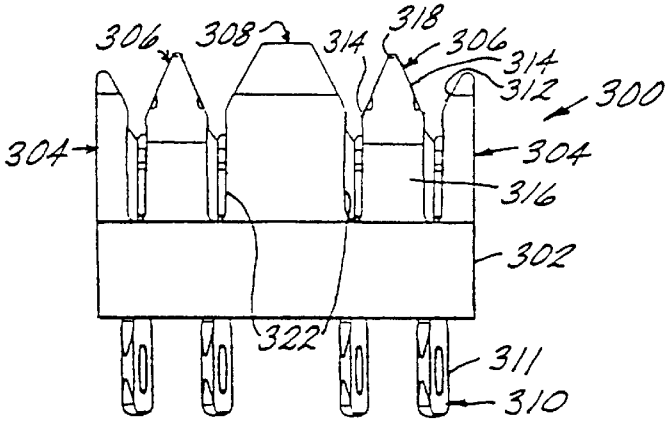

FIG. 17 is a side view of the connecting block 300 in accordance with an exemplary embodiment of the invention. Connecting block 300 includes a generally rectangular base 302 having end walls 304 extending upwards away from the base 302. Also extending away from base 302 are first teeth 306 and a second tooth 308. A gap 324 is provided between end wall 304 [and first teeth 306] and second tooth 308. First teeth 306 separate insulation displacement contacts (IDC) 310 and second tooth 308 separates pairs of IDC's 310. IDC's 310 have press-fit tails 311 as described in U.S. Pat. No. 5,645,445. As is common in the art, a wire is placed in gap 324 and forced down on to the IDC 310 to create an electrical connection between the IDC 310 and the wire.

In accordance with an important aspect of the present invention, tooth 308 has a width along the longitudinal direction greater than the width of first tooth 306. Accordingly, the distance between IDC's in a pair is less than the distance between pairs. This staggered pair spacing reduces the likelihood of crosstalk between pairs and improves performance. The device of this invention further reduces the crosstalk between pairs by the use of a closer spacing of the IDC's within a pair. This closer spacing is achieved by positioning the IDC's in the block at an angle rather than in a parallel line. This closer spacing within a pair also allows for additional spacing between each pair, which also reduces the crosstalk. The IDC's 310 of this invention are also shorter in height and narrower in width than prior art devices, which further reduces the crosstalk.

End wall 304 has an inside surface 312 that tapers towards the outside of end wall 304. Similarly, first tooth 306 includes two inside surfaces 314 that taper towards each other and two outside surfaces 316 that taper toward each other to define point 318 at the distal end of first tooth 306. Tip 318 is narrow and has a width of less than $^{10}/_{1000}$" and is preferably $^{5}/_{1000}$". The tip 318 easily splits the twisted pair wiring without the need to untwist the wire pair prior to lacing and punching down. This improved tip 318 also improves termination of webbed twisted pair cables (each twisted pair is bonded together by a thin web of installation). This improved tip makes for quicker and easier punching down of the block Another benefit of this invention is the distinct spacing between the pairs. This provides for easier visual identification of each pair during installation and servicing.

Figure 21:
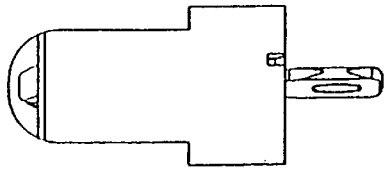
FIGS. 17–21 are views of a connecting block in accordance with the present invention.
Figure 18:
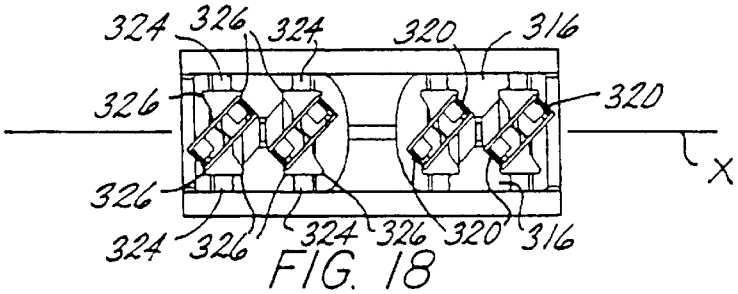
Figure 19:
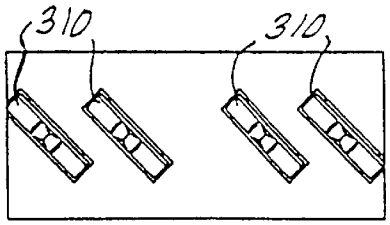
Figure 20:
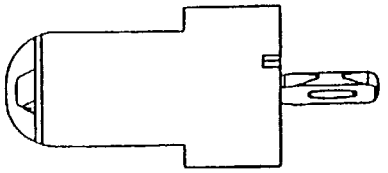
Figure 22:
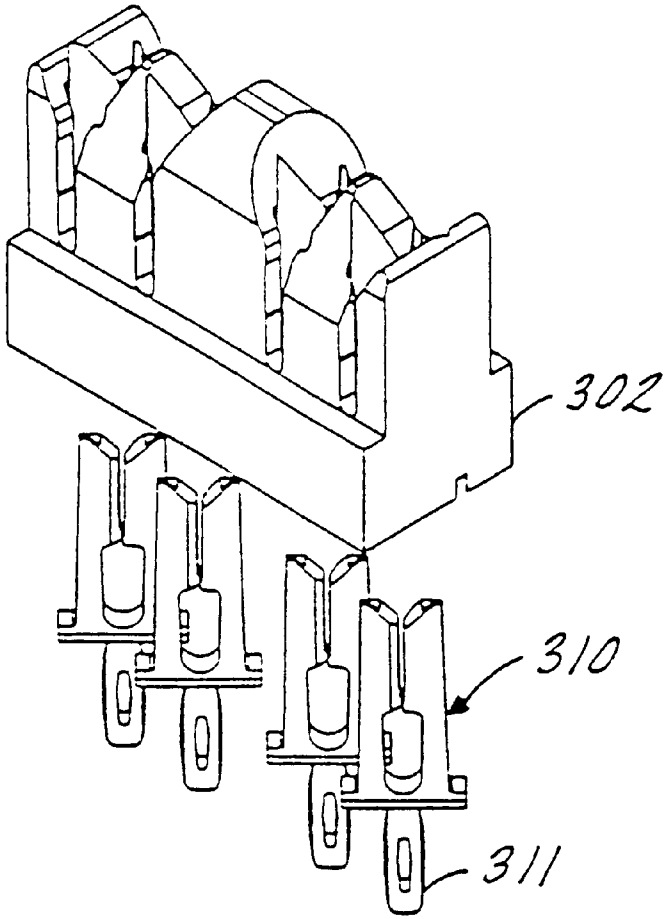
FIG. 22 is an exploded perspective view of the connecting block.

As shown in FIG. 18, inside surface 312 of end wall 304 and inside surface 314 of tooth 306 have a rectangular recess 320 formed therein which receive the edges of IDC 310. The IDC 310 is at an oblique angle relative to the longitudinal axis x of the connecting block 300. In an exemplary embodiment, the IDC 310 is at an angle of 45 degrees relative to the longitudinal axis of the connecting block. Inside surfaces 322 of tooth 308 similarly include a rectangular recess 320 for receiving an edge of the IDC 310. FIG. 19 is a bottom view of the connecting block 300 showing the IDC's 310 at a 45 degree angle relative to the longitudinal axis of the connecting block 300. FIGS. 20 and 21 are end views of the connecting block 300. FIG. 22 is an exploded perspective view of the connecting block showing IDC's 310. Although not shown in the drawings, a metallic barrier may be placed between the pairs to further reduce crosstalk.

Inside surface 312 of end wall 304 includes two notches 326. Similarly, inside surfaces 314 of tooth 306 each includes two notches 326 adjacent to gap 324 and inside surfaces 322 of tooth 308 each include two notches 326 adjacent to gap 324. The notches 326 reduce the amount of material contacting the wire in gap 324 and provide for more pressure per area than without notches 326. The increase in pressure per area more effectively secures wires in gaps 324.

Figure 24:
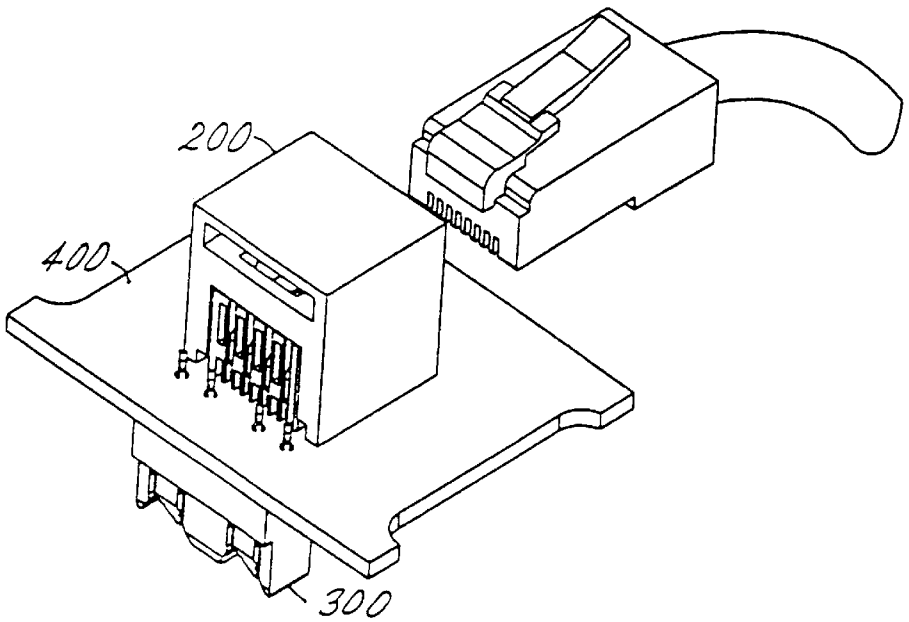
FIGS. 23 and 24 are perspective views of the connector.
Figure 23:
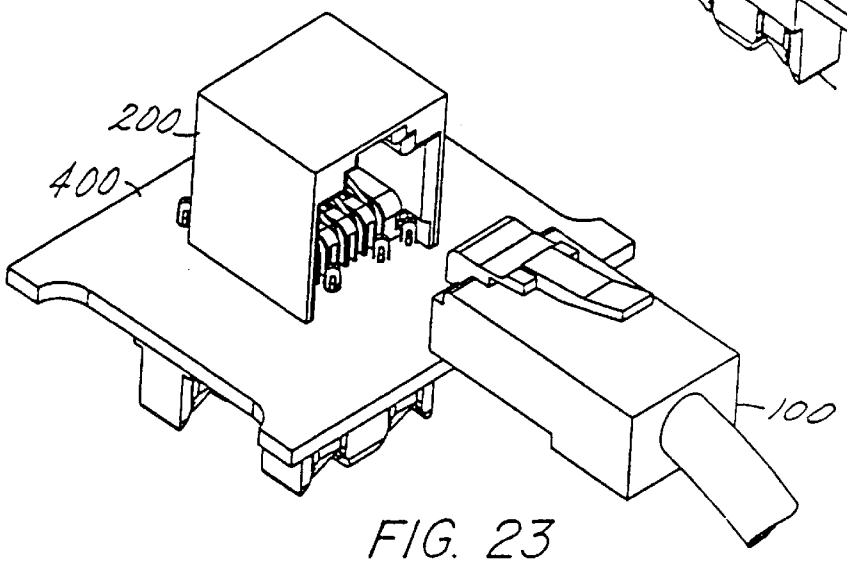
Figure 26:
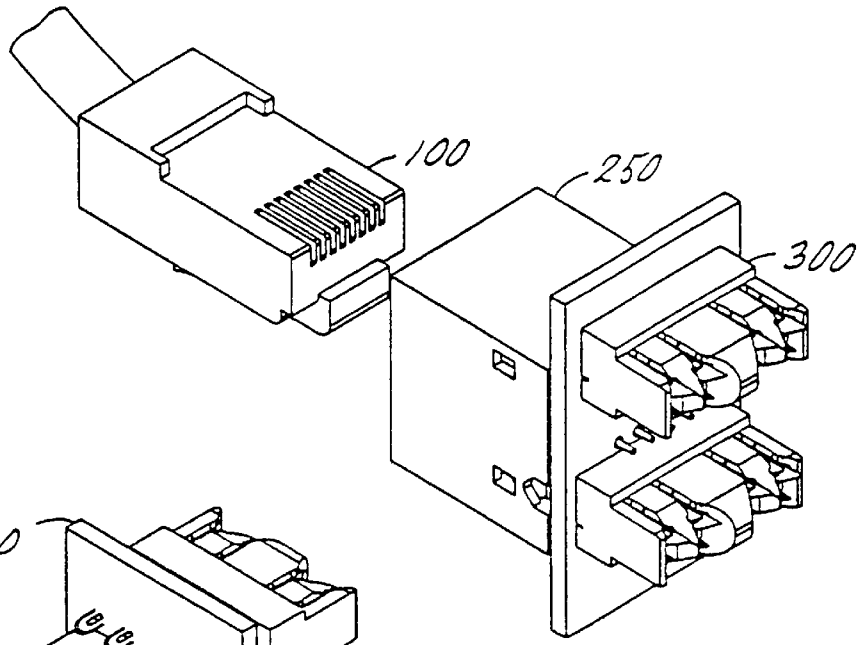
FIGS. 25 and 26 are perspective views of the alternative connector.
Figure 25:
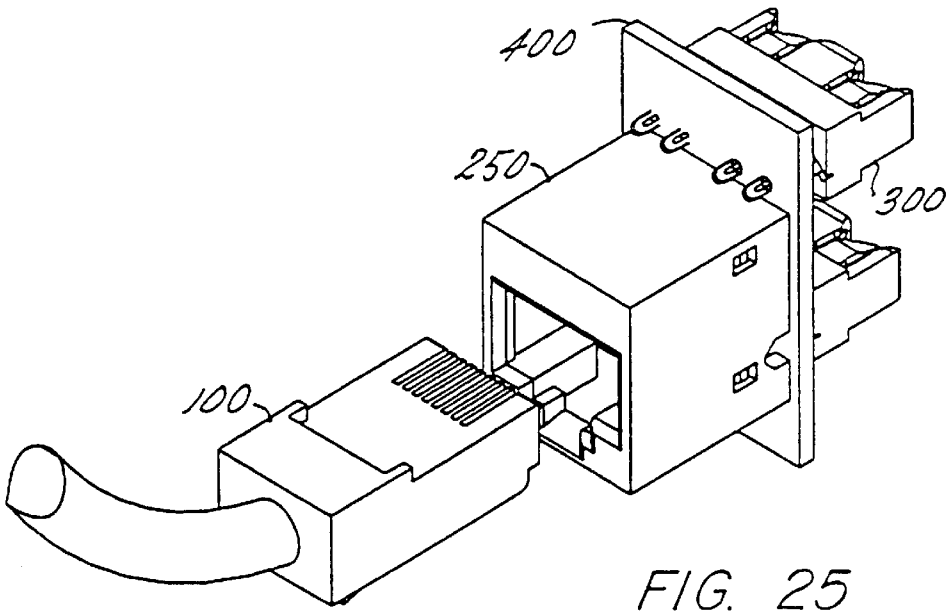

FIGS. 23 and 24 are perspective views of the 90 degree outlet 200 mounted to a circuit board 400. Connecting block 300 is mounted on the opposite side of the circuit board 400. FIGS. 23 and 24 also depict the plug 100 aligned with but not connected with outlet 200. FIGS. 25 and 26 are perspective views of the vertical outlet 250 mounted to a circuit board 400. Connecting block 300 is mounted on the opposite side of the circuit board 400. FIGS. 25 and 26 also depict the plug 100 aligned with but not connected with outlet 250. As described above, the plug, outlet and connecting block are all designed to provide enhanced performance and provide an enhanced performance connector when these components are used together. Although the embodiments described herein are directed to an 8 contact version, it is understood that the features of the outlet, plug and connecting block can be implemented regardless of the number of contacts (e.g. 10, 6, 4, 2).

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telecommunications connecting block comprising:

a base;

a first tooth extending from said base and having a first width and a distal end;

a second tooth extending from said base and having a second width greater than said first width;

a contact positioned on each side of said first tooth;

wherein said first tooth has a pair of outside walls and a pair of inside walls, each of said outside walls tapering towards said distal end and each of said inside walls tapering towards said distal end to define a tip at said distal end.

2. The telecommunications connecting block of claim 1 wherein:

said tip has a width less than ten thousandths of an inch.

3. The telecommunications connecting block of claim 5 wherein:

said telecommunications block includes two end walls, two first teeth and one second tooth.

4. The telecommunications connecting block of claim 1 wherein:

one of said inside walls of said first tooth includes a notch for receiving an edge of said contact.

5. The telecommunications connecting block of claim 1 further comprising:

an end wall adjacent said first tooth.

6. The telecommunications connecting block of claim 5 wherein:

said end wall has an end wall inside surface and an end wall distal end, said end wall inside surface being juxtaposed one of said inside walls of said first tooth, said end wall inside surface tapering towards said end wall distal end.

7. The telecommunications connecting block of claim 1 wherein:

said connecting block has a longitudinal axis passing through said first tooth and said second tooth, said contact being positioned at an oblique angle relative to said longitudinal axis.

8. The telecommunications connecting block of claim 7 wherein:

said oblique angle is 45 degrees.

9. The telecommunications connecting block of claim 8 wherein:

said oblique angle is 45 degrees.

10. A telecommunications connecting block comprising:

a base;

a first tooth extending from said base and having a distal end, said first tooth having a pair of outside walls and a pair of inside walls, each of said outside walls tapering towards said distal end and each of said inside walls tapering towards said distal end to define a tip at said distal end; and a contact positioned on each side of said first tooth.

11. The telecommunications connecting block of claim 10 wherein:

said tip has a width less than ten thousandths of an inch.

12. The telecommunications connecting block of claim 10 wherein:

said connecting block has a longitudinal axis, said contact being positioned at an oblique angle relative to said longitudinal axis.

13. The telecommunications connecting block of claim 10 wherein:

one of said inside walls of said first tooth includes a notch for receiving an edge of said contact.

14. The telecommunications connecting block of claim 10 further comprising:

an end wall adjacent said first tooth.

15. The telecommunications connecting block of claim 14 wherein:

said end wall has an end wall inside surface and an end wall distal end, said end wall inside surface being juxtaposed one of said inside walls of said first tooth, said end wall inside surface tapering towards said end wall distal end.

* * * * *

UNITED STATES PATENT AND TRADEMARK OFFICE

CERTIFICATE OF CORRECTION

PATENT NO. : 6,126,476
DATED : October 3, 2000
INVENTOR(S) : Viklund et al.

It is certified that error appears in the above-identified patent and that said Letters Patent is hereby corrected as shown below:

Title page,
Item [75], after "New Milford" delete "; Olindo Savi, Berlin; Joshua Adams, Manchester, all of Conn." and insert therefor -- , Conn. --

Column 2,
Line 58, after "FIG." delete "12" and insert therefor -- 11 --

Signed and Sealed this

Twenty-third Day of December, 2003

JAMES E. ROGAN
*Director of the United States Patent and Trademark Office*